US005560449A

United States Patent [19]

Smith

[11] Patent Number: 5,560,449

[45] Date of Patent: Oct. 1, 1996

[54] ADJUSTABLE TRESTLE SAWHORSE

[76] Inventor: Brian S. Smith, 1304 Brixton Rd., Pasadena, Calif. 91105

[21] Appl. No.: 533,544

[22] Filed: Sep. 25, 1995

[51] Int. Cl.[6] ..... B27B 21/00

[52] U.S. Cl. ..... 182/153; 182/225

[58] Field of Search ..... 182/225–227, 182/181–186, 153–155

[56] References Cited

U.S. PATENT DOCUMENTS

| | | | |
|---|---|---|---|
| 374,107 | 11/1887 | Zeigler | 182/153 |
| 1,001,344 | 8/1911 | Boyer | 182/153 |
| 4,917,341 | 4/1990 | Pirchio | 248/164 |

*Primary Examiner*—Alvin C. Chin-Shue

[57] ABSTRACT

An adjustable sawhorse for contemporaneously adjusting both the height and angle of inclination of the support member. The sawhorse utilizes a disk-jaw slip clutch composed of a shaft carrying a pair of inner and outer disks in slideable and rotational relationship. The shaft extends through a transverse cavity in the support member and the support member is interposed intermediately of the disks. A plurality of radially extending jaws extend from the transverse cavity openings in the support member sidewall surfaces for engagement with corresponding radially extending jaws on the inner disks' engagement surface with the support member. Similarly, the outer disks have radially extending jaws which couple with like constructed jaws on the engagement faces of the outer disks. By exertion of a lateral compressive force, the disks and support member may be releasably locked in fixed rotational relationship. A first truss leg extends radially from the inner disks and a second truss leg extends radially from the outer disks to stabilize the sawhorse.

9 Claims, 5 Drawing Sheets

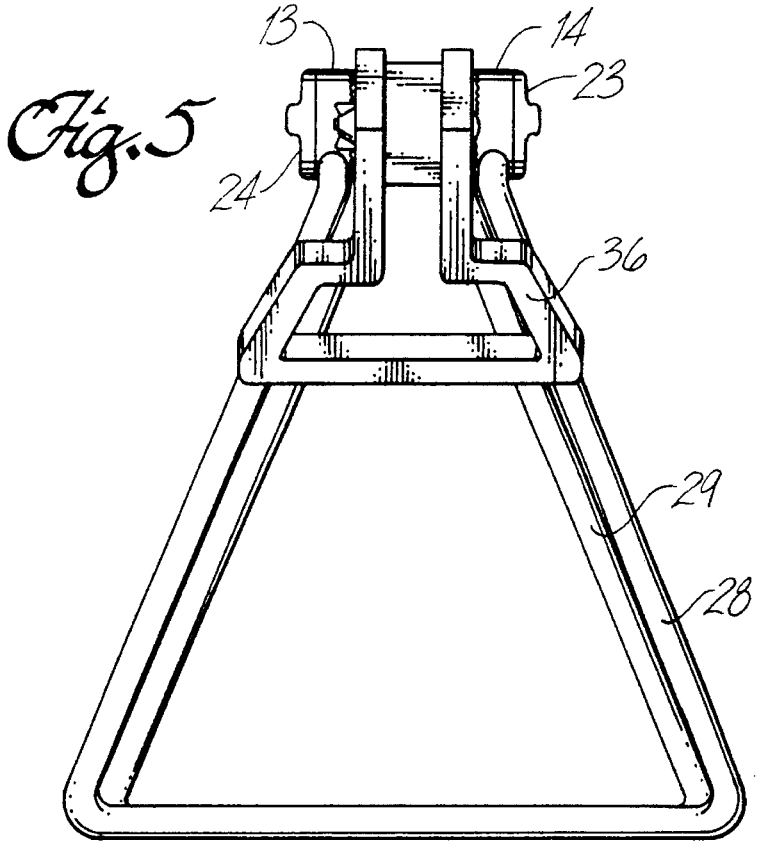
FIG. 6
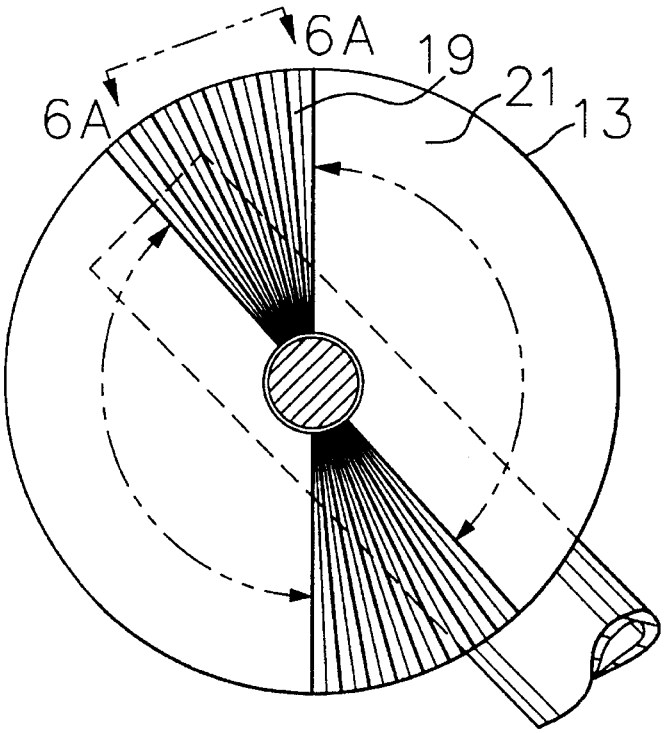
FIG. 6A
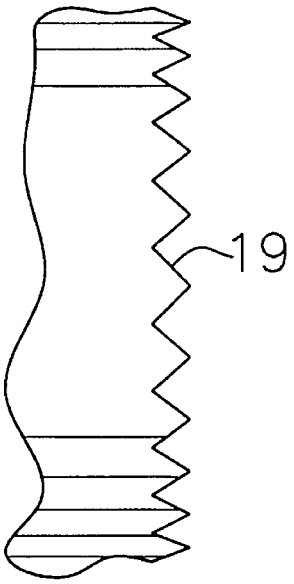

ADJUSTABLE TRESTLE SAWHORSE

FIELD OF THE INVENTION

This invention relates to an adjustable trestle sawhorse for use in supporting work pieces by contemporaneous adjustment of the height and attitude of the load bearing surface of the trestle structure.

BACKGROUND OF THE INVENTION

A workpiece support apparatus, such as a trestle sawhorse having the capability of both angularly adjusting the truss support legs of the trestle while simultaneously providing angular adjustment of the load bearing support member presents a greater flexibility of application over sawhorses of the prior art.

Typically, long pieces of lumber, wall panels, or sections of sheet metal could not be properly supported by a bench alone and therefore required sawhorse type trestles to assist in adequately supporting such materials while work was being done. There are many devices in the prior art for supporting such workpieces. For example, in U.S. Pat. No. 5,064,156, an improved adjustable height work support is shown where the support has a means for locking the support at any desired height. It would be desirable, however, in addition to adjusting the height of the sawhorse to have the capability to change the angle of the load bearing surface of the sawhorse to accommodate different types of workpieces.

It would also be desirable to provide an improved sawhorse support device where an adjustment to the truss legs of the device and an adjustment to the angular relationship between the truss legs and the support bearing surface of the sawhorse are easily locked in fixed rotational relationship.

SUMMARY OF THE INVENTION

There is, therefore, provided according to the present invention, an improved adjustable sawhorse trestle for Contemporaneously adjusting both the height of the sawhorse and the angle c,f the support bearing surface of the sawhorse.

The present invention is directed to an adjustable sawhorse trestle for supporting a work piece at various heights and inclinations to the vertical. The adjustable sawhorse trestle consists of a support member having an axis of elongation and a cavity extending through the support member transversely to the axis of elongation. To permit contemporaneous height adjustability and selectable support member inclination to the vertical, a disk-type clutch mechanism is utilized. The clutch consists of a shaft which is carried by the support member and extends at least in part through a transversely extending cavity located intermediately of the support member; a pair of outer disks are slideably and rotationally mounted to the shaft where the support member is interposed between each of the outer disks respectively. In addition to the outer disks, a pair of inner disks are slideably and rotationally mounted to the shaft and located adjacent to the outer disks and interposed between the outer disks and the support member. In the preferred embodiment, the inner and outer disks have symmetrically construed engagement surfaces contained on the lateral side of the disks. The engagement surfaces have a plurality of radially extending jaws which under a compressive force couple thereby rotationally locking the disks together. To couple the inner disks to the support member, radially extending jaws are also utilized on the sidewall surfaces of the support member and extend radially from the center of the openings of the transverse cavity in the sidewall surfaces. Thus, the engagement face of each inner disk adjacent the support member will releasably lock with the corresponding jaws of the support member upon a compressive force being applied along the shaft axis.

A truss leg member defined by a pair of interconnected leg struts captively carried by both inner disks where each leg strut extends radially from a respective disk such that the angular relationship between the leg struts and the axis of elongation may be selectively varied by rotation of the inner disks with respect to the shaft. A second truss member is captively carried in the same manner by each of the outer disks and the second truss member has leg struts which extend radially from the outer disks such that the angular relationship between the second truss leg and the axis of elongation or the vertical may be selectively varied by rotation of the outer disk with respect to the shaft to strengthen the trestle of the sawhorse, adjustably mounted first and second brace members are adapted in a sliding pivotal mounting relationship with the support member to permit the brace members to be selectively spaced axially from the transverse cavity in locked pivotal relationship with the support member. This permits a bearing engagement with the first and second truss legs respectively to strengthen the trestle. Thus, the first and second brace members act to redistribute the stress load acting on the jaws extending from the cavity opening and coupled to the adjacent jaws of the inner disk.

An instrument, therefore, for selectively adjusting the angle of incidence between the load support bearing member of a sawhorse trestle and the vertical is provided where in addition to selectively adjusting the angle of the load support member, the height of the support member is also selectively adjustable.

BRIEF DESCRIPTION OF THE DRAWINGS

These and other features and advantages will become appreciated as the same become better understood with reference to the following specification, claims

FIG. 5 is a side left side elevational view of the sawhorse trestle illustrated in FIG. 1.

FIG. 6 is a part cross-sectional view taken along the line 6—6 of FIG. 4.

FIG. *6a* is a part cross-sectional view taken along the line *6a—6a* of FIG. 6.

DETAILED DESCRIPTION

Figure 1:
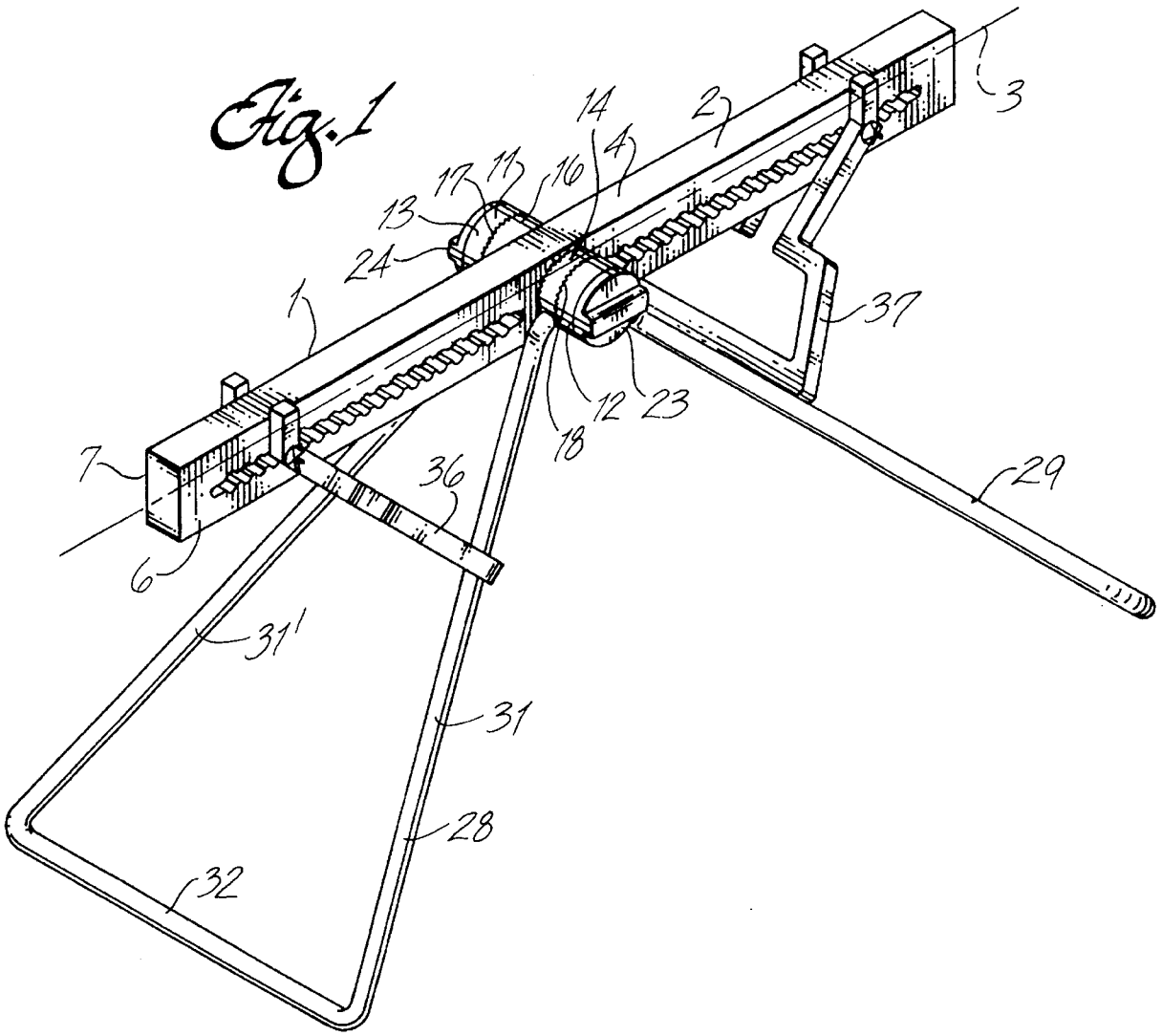
FIG. 1 is a perspective view of the trestle sawhorse of this invention.
Figure 2:
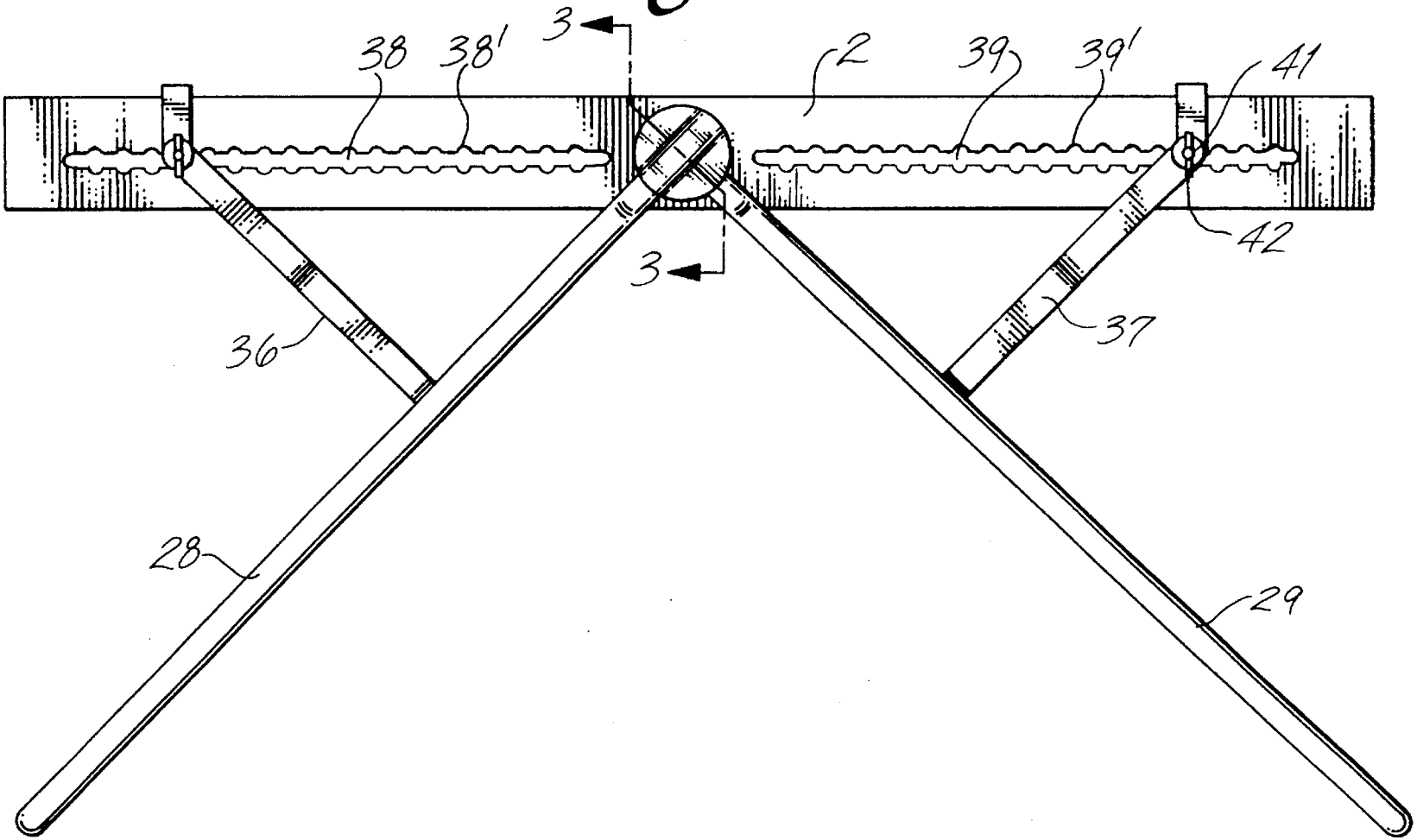
FIG. 2 is a left side elevational view of the sawhorse trestle illustrated in FIG. 1.
Figure 3:
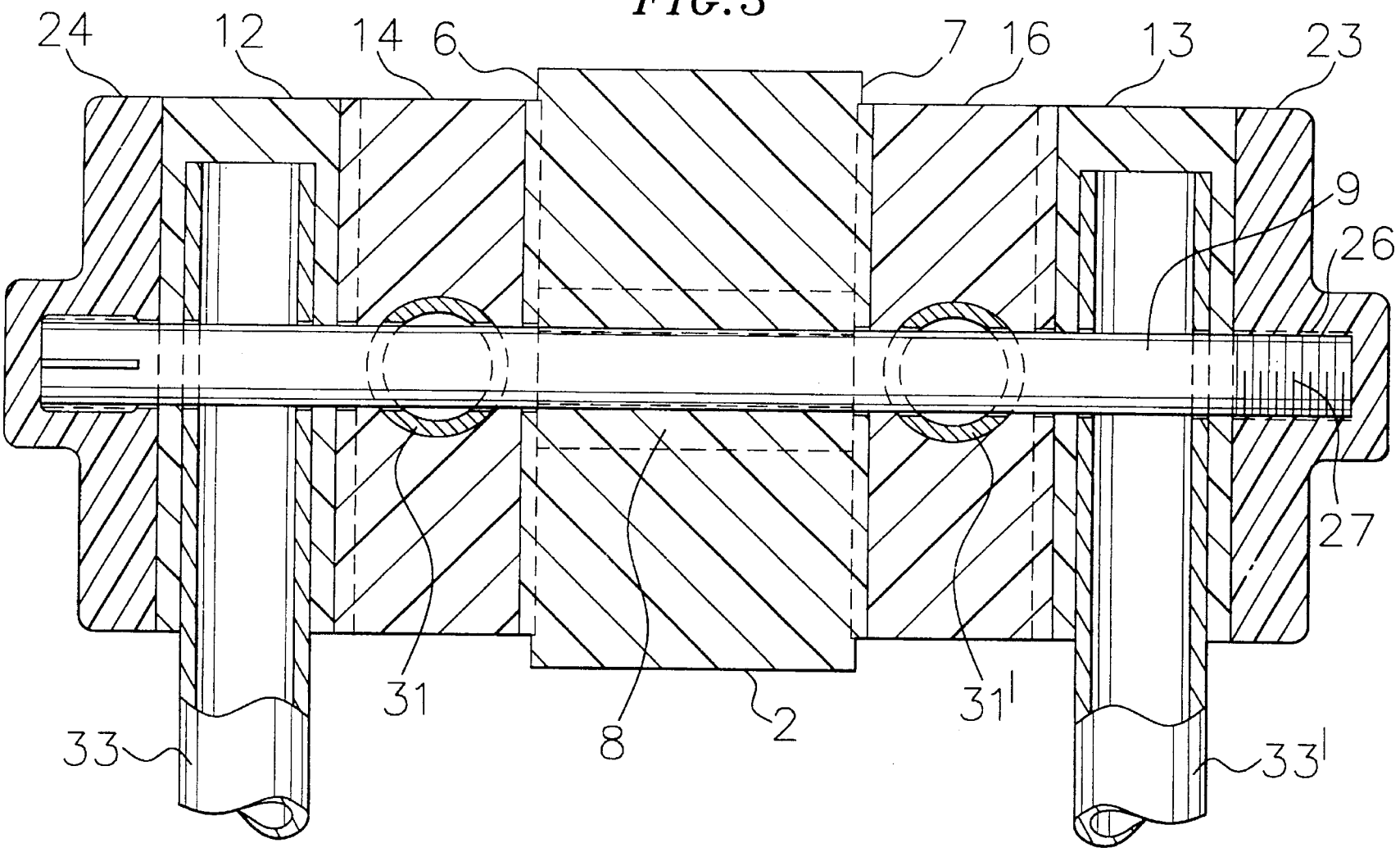
FIG. 3 is a cross-sectional view taken along the line 3—3 of FIG. 2.

The selectively adjustable trestle sawhorse of this invention is shown in perspective in FIG. 1. As can be seen in FIG. 1, the selectively adjustable trestle sawhorse 1 has a support member 2 which in the preferred embodiment is rectangularly shaped and has an axis of elongation 3, a load bearing surface 4 and side wall surfaces 6 and 7. Although not shown on FIG. 1, support member 2 has a transverse cavity 8 which can be seen by reference to FIG. 3 for accepting shaft member 9.

To selectively adjust support member 2 with respect to the vertical in the preferred embodiment of this invention, a disk-jaw slip clutch arrangement is utilized. By referring to FIG. 1, the disk-jaw clutch can be seen to be comprised of in addition to shaft member 9, a pair of outer disks 12 and 13 which are rotationally and slideably mounted to shaft 9; and a pair of inner disks 14 and 16 which are also slideably and rotationally mounted to shaft 9. FIG. 1 also illustrates the coupling feature of the inner and outer disks 17 and 18, however, by referring to FIG. 6 and 6*a*, it can be seen that the coupling feature consists of radially extending jaws 19 located in the engagement faces 21 and 22 of outer and inner disks 13 and 16 respectively (see FIG. 4). Similarly, the engagement faces between outer disk 12 and inner disk 14, although not shown, have radially extending jaws as illustrated in FIGS. 6 and 6*a*.

The coupling feature of inner disks 14 and 16 with the support member 2 in the preferred embodiment utilizes radially extending jaws of the type shown in FIGS. 6 and 6*a* contained in the side wall surfaces 6 and 7 of support member 2. The jaws extend radially from the opening of the transverse cavity in side wall surfaces 6 and 7. The engagement surfaces of inner disks 14 and 16 with side wall surfaces 6 and 7 also contain radially extending jaws of the type illustrated in FIGS. 6 and 6*a* and upon compressive engagement with the corresponding jaws contained in side wall surfaces 6 and 7, the inner disks 14 and 16 are in locked rotational relationship with the support member 2.

Referring again to FIG. 3 it can be seen that shaft 9 has a pair of compression plates 23 and 24 where compression plate 24 is rotationally locked to shaft member 9. Compression plate 23 has internal threads 26 for engaging threads 27 on the tip of shaft 9. The threaded arrangement permits compression plate 23 to be tightened by threading compression plate 23 along threads 27 thereby applying compressive forces to the inner and outer disks. This locks the disks together and also locks them to the support member thereby precluding relative rotation between them. The disk-jaw slip clutch 11 arrangement as described above permits the load bearing surface 4 of the support member to be inclined selectively with respect to the vertical by adjusting the tightness of compression plate 23 against outer disk 13.

In addition to selectively changing the attitude of support member 2, the trestle sawhorse apparatus is height adjustable. Thus, the slip clutch also permits the height of support member 2 to be selectively adjustable. By referring to FIG. 1, it can be seen that sawhorse 1 has a first truss member 28 and a second truss member 29 which are comprised of leg struts 31 and 31' and connecting member 32 which is integrally connected to leg struts 31 and 31'. Similarly, second truss member 29 (see FIG. 4) has leg struts 33 and 33' and connecting member 34 which is integrally connected to leg struts 33 and 33'. In the preferred embodiment the leg struts and connecting members are tubular members and made of a rigid material which may be a rigid plastic material. By referring to FIG. 3, it can be seen that leg struts 31 and 31' are carried by inter disks 14 and 16 respectively; and in the preferred embodiment are rigidly mounted to the disks and in fixed rotational relationship with them. Similarly, leg struts 33 and 33' are rigidly affixed to outer struts 12 and 13 respectively in fixed rotational relationship with the disks. Thus, by loosening compression plate 23, first truss member 28 may be selectively positioned by the rotation of disks 14 and 16 which have been uncoupled from support member 2 and outer disks 12 and 13. Second truss member 29 may also be selectively rotated to a desired position and both first and second truss members thereafter locked in fixed relationship to the support member 2 by tightening compression plate 23.

Figure 4:
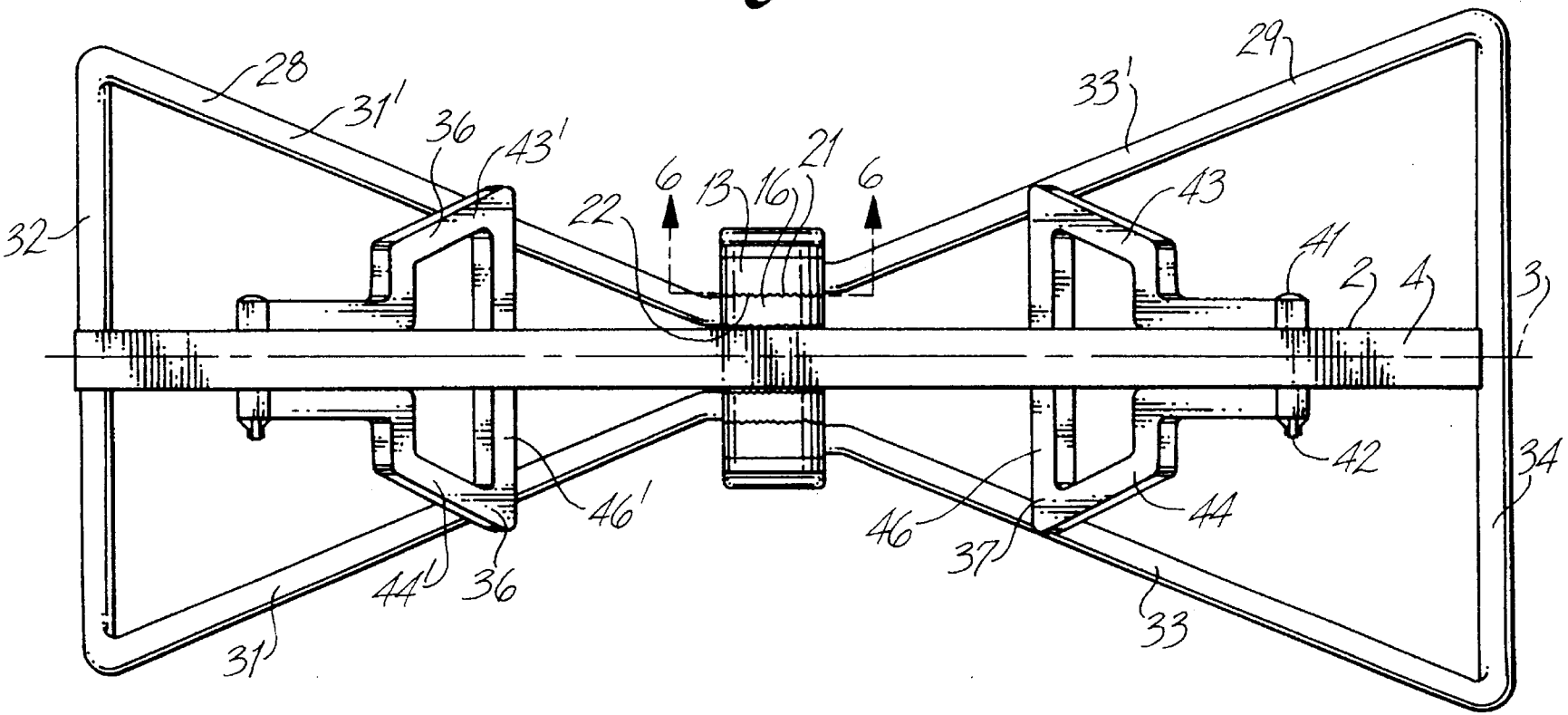
FIG. 4 is a top view of the sawhorse trestle shown in FIG. 1.

To strengthen the sawhorse trestle, pivotally mounted first brace member 36 and second brace member 37 are utilized the trestle structure. The brace members are so adapted and mounted in a pivotal and adjustable relationship with the support member that the brace member is permitted to be selectively spaced axially from cavity 8 of support member 2. Brace members 36 and 37 are illustrated in FIGS. 1, 2, 3, 4 and 5 from different perspectives. By referring to FIG. 2, the axial adjustability of the first and second brace members can be seen. Axially extending locks 38 and 39 have a multiplicity of notches 38' and 39' into which a fastener 41 may be inserted and a brace member thereafter locked in the notch by tightening a wing nut 42 sufficiently to preclude axial and rotational movement relative to support member 2. By referring to FIGS. 4 and 5, the structure of brace members 36 and 37 can be readily observed. Brace members 36 and 37 are identically constructed, and as can be seen in FIG. 4, they are continuous members having support arms 43 and 44 which are interconnected by bearing arm 46. Bearing arm 46 bears against the leg struts 33 and, 33' of second truss member 29. Similarly, first brace member 36 has support arms 43'0 and 44' which are interconnected by bearing arm 46'. Thus, it can be seen that bearing arms 46 and 46' by bearing against the leg struts of the truss members strengthen the sawhorse trestle by minimizing the torque load acting on the jaws of the inner and outer disks interacting with each other and the interaction of the inner disk with the jaws contained on the sidewall surfaces of support member 2.

While I have shown and described an embodiment of the present adjustable sawhorse trestle, it is to be understood that the invention is subject to many modifications without departing from the scope and spirit of the claims as recited herein. This invention is not to be limited by the embodiment shown in the drawings and described in the description which is given by way of example and not of limitation.

What is claimed is:

1. An adjustable trestle for supporting a workpiece comprising:

a) a support member having an axis of elongation and a transverse cavity extending laterally therethrough;

b) a shaft carried by said support member and extending at least in part through said cavity;

c) a pair of outer disks slideably and rotationally mounted to said shaft where said support member is interposed between said outer disks;

d) a pair of inner disks slideably and rotationally mounted to said shaft adjacent said outer disks and interposed between said outer disks and said support member respectively;

e) a first truss member captively carried by said inner disks and extending radially therefrom such that the angular relationship between said first truss member and said axis of elongation may be selectively varied by rotation of said inner disks with respect to said shaft;

f) a second truss member captively carried by said outer disks and extending radially therefrom such that the angular relationship between said second truss member and said axis of elongation may be selectively varied by rotation of said outer disks with respect to said shaft;

g) clutch means responsive to lateral compression associated with said support member and said outer and said inner disks for selectively and releasably locking said support member and said outer and inner disks in fixed rotational relationship.

2. The adjustable trestle recited in claim 1 further comprising:

a first brace member so adapted in pivotal and adjustable mounting relationship with said support member to permit said first brace member to be selectively spaced axially from said transverse cavity and releasably locked in pivotal relationship with said support member.

3. The adjustable trestle recited in claim 2 further comprising:

a second brace member so adapted in pivotal and adjustable mounting relationship with said support member to permit said second brace member to be selectively spaced axially from said transverse cavity and locked releasably in pivotal relationship with said support member.

4. The adjustable trestle recited in claim 1 wherein said support member has opposing side wall surfaces extending axially with openings therein communicating with said transverse cavity, said support member further comprising a multiplicity of jaws integrally carried by said support member and extending radially from said openings, where said inner disks have opposing engagement surfaces containing a multiplicity of radially extending jaws so dimensioned and proportioned to permit said inner disks to be in releasably locked rotational relationship with said support member and said outer disks upon lateral compression of said outer and inner disks.

5. The adjustable trestle recited in claim 4 further comprising:

a first brace member so adapted in pivotal and adjustable mounting relationship with said support member to permit said first brace member to be selectively spaced axially from said transverse cavity and releasably locked in pivotal relationship with said support member.

6. The adjustable trestle recited in claim 5 further comprising:

a second brace member so adapted in pivotal and adjustable mounting relationship with said support member to permit said second brace member to be selectively spaced axially from said transverse cavity and releasably locked in pivotal relationship with said support member.

7. The adjustable trestle recited in claim 1 wherein said clutch means further comprises a first clutch means associated with said inner disks and said outer disks responsive to lateral compressive forces for selectively and releasably locking said inner and outer disks in fixed rotational relationship and further comprising a second clutch means associated with said support member and said inner disks responsive to said lateral compressive force for selectively releasably locking said support member and said inner disks in fixed rotational relationship.

8. The adjustable trestle recited in claim 7 further comprising:

a first brace member so adapted in pivotal and adjustable mounting relationship with said support member to permit said first brace member to be selectively spaced axially from said transverse cavity and releasably locked in pivotal relationship with said support member.

9. The adjustable trestle recited in claim 8 further comprising:

a second brace member so adapted in pivotal and adjustable mounting relationship with said support member to permit said second brace member to be selectively spaced axially from said transverse cavity and releasably locked in pivotal relationship with said support member.

* * * * *